US010443632B2

(12) United States Patent
Jones et al.

(10) Patent No.: US 10,443,632 B2
(45) Date of Patent: Oct. 15, 2019

(54) APPARATUS AND METHOD FOR A HYDRAULIC SYSTEM

(71) Applicant: Deere & Company, Moline, IL (US)

(72) Inventors: Amy K. Jones, Dubuque, IA (US); Richard Pugh, Duqubue, IA (US); Kristen D. Cadman, Dubuque, IA (US)

(73) Assignee: Deere & Company, Moline, IL (US)

( * ) Notice: Subject to any disclaimer, the term of this patent is extended or adjusted under 35 U.S.C. 154(b) by 18 days.

(21) Appl. No.: 15/812,298

(22) Filed: Nov. 14, 2017

(65) Prior Publication Data

US 2019/0145438 A1 May 16, 2019

(51) Int. Cl.

| | |
|---|---|
| ***F15B 19/00*** | (2006.01) |
| ***F15B 1/26*** | (2006.01) |
| ***F15B 21/041*** | (2019.01) |
| ***E02F 3/43*** | (2006.01) |
| ***E02F 9/22*** | (2006.01) |
| ***E02F 3/42*** | (2006.01) |
| ***E02F 3/28*** | (2006.01) |

(52) U.S. Cl.

CPC ..... *F15B 19/005* (2013.01); *E02F 3/422* (2013.01); *E02F 3/431* (2013.01); *E02F 9/2235* (2013.01); *E02F 9/2296* (2013.01); *F15B 1/26* (2013.01); *F15B 21/041* (2013.01); *E02F 3/283* (2013.01)

(58) Field of Classification Search

CPC ..... F15B 19/0005; F15B 21/041; F15B 1/26; E02F 3/422; E02F 9/2235; E02F 9/2296

See application file for complete search history.

(56) References Cited

U.S. PATENT DOCUMENTS 4,469,594 A * 9/1984 Poetter ..... B01D 35/12 210/108
4,480,160 A * 10/1984 Stifelman ..... H01H 35/38 200/82 D (Continued)

FOREIGN PATENT DOCUMENTS

JP 2012-41767 * 3/2012
JP 2014-173326 * 9/2014

*Primary Examiner* — Michael J Zanelli

(57) ABSTRACT

A vehicle comprising a hydraulic fluid reservoir, a hydraulic fluid pump, a hydraulic filter, a sensor, and a vehicle control unit. The hydraulic fluid reservoir may have a bottom portion filled with hydraulic fluid and a top portion filled with air. The hydraulic fluid pump may be hydraulically coupled to the hydraulic fluid reservoir so as to draw hydraulic fluid from the hydraulic fluid reservoir. The hydraulic filter may be hydraulically coupled to the hydraulic fluid reservoir so as to filter debris from the hydraulic fluid entering the hydraulic fluid reservoir. The sensor may be in communication with the vehicle control unit where the sensor is configured to measure a variable indicative of a failure status of the hydraulic filter and communicate the variable to the vehicle control unit. The vehicle control unit may be configured to derate the hydraulic fluid pump to a first degree when the variable indicative of the failure status of the hydraulic filter is above a first threshold and configured to derate the hydraulic fluid pump to a second degree when the variable indicative of the failure status of the hydraulic filter is above a second threshold.

20 Claims, 4 Drawing Sheets

(56) References Cited

U.S. PATENT DOCUMENTS

| | | | | |
|---|---|---|---|---|
| 5,239,861 | A * | 8/1993 | Fujita | B01D 29/05 73/61.73 |
| 2013/0226415 | A1* | 8/2013 | Smith | E02F 9/2235 701/50 |
| 2015/0120105 | A1* | 4/2015 | Naqvi | B60L 15/20 701/22 |
| 2015/0247451 | A1 | 9/2015 | Gratton et al. | |
| 2015/0258972 | A1* | 9/2015 | Majeskie | B61H 13/00 303/10 |
| 2015/0267371 | A1* | 9/2015 | Ciccotelli | E02F 3/205 405/263 |
| 2016/0273471 | A1 | 9/2016 | Shimpi et al. | |

* cited by examiner

APPARATUS AND METHOD FOR A HYDRAULIC SYSTEM

CROSS-REFERENCE TO RELATED APPLICATIONS

N/A

FIELD OF THE DISCLOSURE

The present disclosure relates to a hydraulic system for a vehicle.

BACKGROUND

Vehicles may utilize fluid reservoirs to collect various fluids, such as hydraulic fluid, engine oil, or coolant. For certain vehicles, or certain applications of a vehicle, it may be desirable to pressurize the fluid reservoir above atmospheric pressure, as in a hydraulic systems to transmit power to the mechanism which produce work. The hydraulic fluid is the medium by which this power is transmitted. Furthermore, hydraulic fluid lubricates moving parts; must be stable for long periods of time; must protect the vehicle from rust and corrosion; must resist foaming and oxidation; and separate readily from air, water, and other contaminants. The hydraulic fluid must also maintain proper viscosity through a wide temperature range, and finally, and be readily available and reasonably economical to use. For proper power transmission, the viscosity of the hydraulic fluid must be maintained. Most hydraulic fluids, such as oils, tend to become thin as its temperature increases, and thickens as its temperature drops. If the viscosity is too low, the possibility of leakage past seals and from joints is increased. If the viscosity is too high, sluggish operation results and extra horsepower is required to push the hydraulic fluid through the system. Contaminants such as metallic particles, dust, and dirt not only affect the viscosity of the hydraulic fluid, but may also damage closely fitted components, and induce oxidation, thereby accelerating rust and corrosion of components. Small particles may score valves, seize pumps, clog orifices, and cause premature failure of components such that leakage can become an environmental concern. Therefore, regular maintenance is required for optimum performance. The following disclosure describes an apparatus and method which encourages the operator to perform maintenance to prevent irreparable damage to the hydraulic system of a vehicle.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

According to an aspect of the present disclosure, a vehicle may comprise a hydraulic fluid reservoir, a hydraulic fluid pump, a hydraulic filter, a sensor, and a vehicle control unit. The hydraulic fluid reservoir may have a bottom portion filled with hydraulic fluid and a top portion filled with air. The hydraulic fluid pump may be hydraulically coupled to the hydraulic fluid reservoir so as to draw hydraulic fluid from the hydraulic fluid reservoir. The hydraulic filter may be hydraulically coupled to the hydraulic fluid reservoir so as to filter debris from the hydraulic fluid entering the hydraulic fluid reservoir. The sensor may be in communication with the vehicle control unit where the sensor is configured to measure a variable indicative of a failure status of the hydraulic filter and communicate the variable to the vehicle control unit. The vehicle control unit may be configured to derate the hydraulic fluid pump to a first degree when the variable indicative of the failure status of the hydraulic filter is above a first threshold.

The vehicle control unit may further be configured to derate the hydraulic fluid pump to a second degree when the variable indicative of the failure status of the hydraulic filter is above a second threshold. The vehicle control unit may derate the hydraulic fluid pump by limiting at least the displacement, output pressure, torque, or power output.

The variable indicative of the failure status of the hydraulic filter may be activation of a switch. The switch may be activated when the pressure differential across the hydraulic filter exceed a third threshold. The switch may be further deactivated when the pressure differential across the hydraulic filter is below the third predetermined threshold.

Another means the switch may be activated is when the pressure within the hydraulic fluid reservoir exceeds a fourth threshold. The switch may be further deactivated when the pressure within the hydraulic fluid reservoir drops below the fourth threshold.

The first threshold may be either a number of occurrences or a frequency of occurrences of activation of the switch. This may be measured over an incremental unit. The incremental unit may comprise of a time period, a distance, a number of tree counts, a number of dig cycles, or a number of dump cycles.

According to another aspect of the present disclosure, a method of controlling a vehicle with a hydraulic fluid reservoir and a hydraulic fluid pump, wherein the hydraulic fluid reservoir comprises a bottom portion filled with a hydraulic liquid and a top portion filled with air. The method may comprise measuring a variable indicative of a failure status of a hydraulic filter; derating the hydraulic fluid pump to a first degree when the variable is above a first threshold; and derating the hydraulic fluid pump to a second degree when the variable is above a second threshold wherein the hydraulic fluid pump is hydraulically coupled to the hydraulic fluid reservoir so as to draw hydraulic fluid from the hydraulic fluid reservoir.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

The embodiments disclosed in the above drawings and the following detailed description are not intended to be exhaustive or to limit the disclosure to these embodiments. Rather, there are several variations and modifications which may be made without departing from the scope of the present disclosure.

Figure 1:
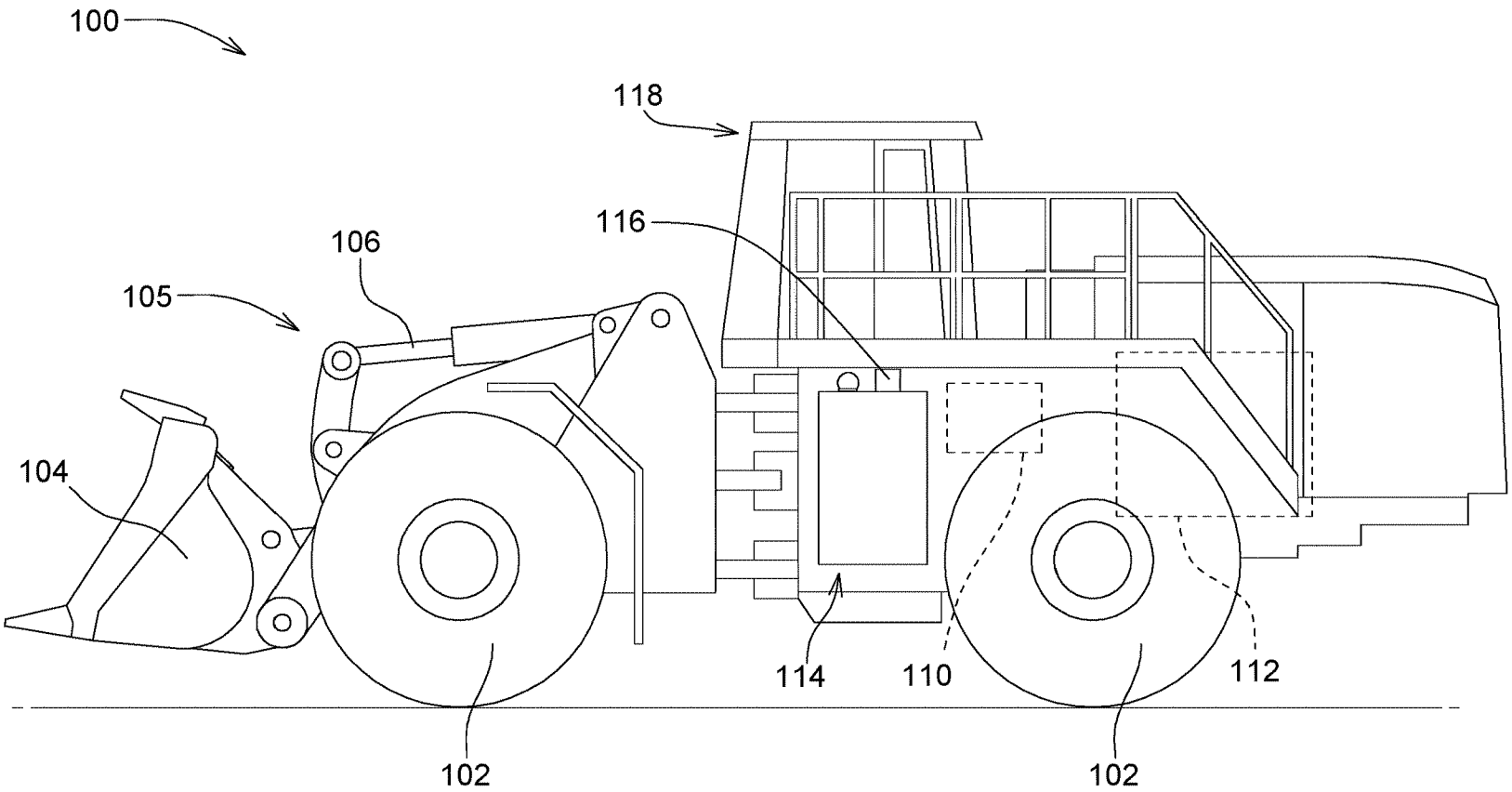
FIG. 1 is a side view of a vehicle with a hydraulic fluid reservoir and a hydraulic fluid pump.

FIG. 1 illustrates vehicle 100, comprising wheels 102, tool 104, tool linkage 105, tool cylinder 106, hydraulic fluid pump 110, hydraulic fluid reservoir 114, hydraulic filter 116, engine 112, and operator station 118.

Vehicle is a wheel loader, but the vehicle may also be another vehicle with a system that does not directly pressurize the hydraulic fluid pump (e.g. an excavator, a backhoe loader, a crawler, a feller buncher, a forwarder, a harvester, a knuckleboom loader, a motor grader, a scraper, a skidder, a skid steer loader, a track loader, a tractor, a combine, or a truck). The powertrain of the vehicle 100 engage the ground wheels 102, of which there are four, which roll on the ground and provide support and traction for vehicle 100.

Tool 104 is positioned at the front end of the vehicle and is connected to vehicle 100 by tool linkage 105. Tool 104 is a hydraulically actuated bucket which may be loaded with material, such as dirt, gravel, or rock. Tool 104 has two pivotal connections to tool linkage 105, enabling tool linkage 105 to control both the height and rotation of the tool 104. Tool linkage 105 consists of multiple rigid members, many of which are pivotally connected to each other, that transfer forces between tool 104 and the remainder of vehicle 100. Tool cylinder 106 is pivotally connected to tool linkage 105, the aspect which controls the rotation of tool 104. This aspect may be referred to as bucket curl and bucket dump. Additional hydraulic cylinders (not shown) may actuate and control another aspect of tool linkage 105, the aspect which controls the height of tool 104. This aspect may be referred to as boom raise and boom lower. Tool cylinder 106 is a hydraulic double-acting cylinder with a pivotal connection at each of its ends. Tool cylinder 106 may thereby be used to actuate tool 104. Tool cylinder 106 is referred to as "double-acting" because it may, depending on how it is hydraulically controlled, generate force tending to extend tool cylinder 106 or force tending to retract tool cylinder 106. When tool cylinder 106 extends, tool 104 curls, or rotates clockwise when viewed from the left such that the front of tool 104 moves upwards and material is trapped by gravity within tool 104. When tool cylinder retracts, tool 104 dumps, or rotates counterclockwise when viewed from the left such that the front end of the tool 104 moves downwards and material is ejected from tool 104 by gravity. Vehicle 100 includes other hydraulic cylinders, including those controlling the height of the tool 104 and the steering of vehicle 100.

Figure 2:
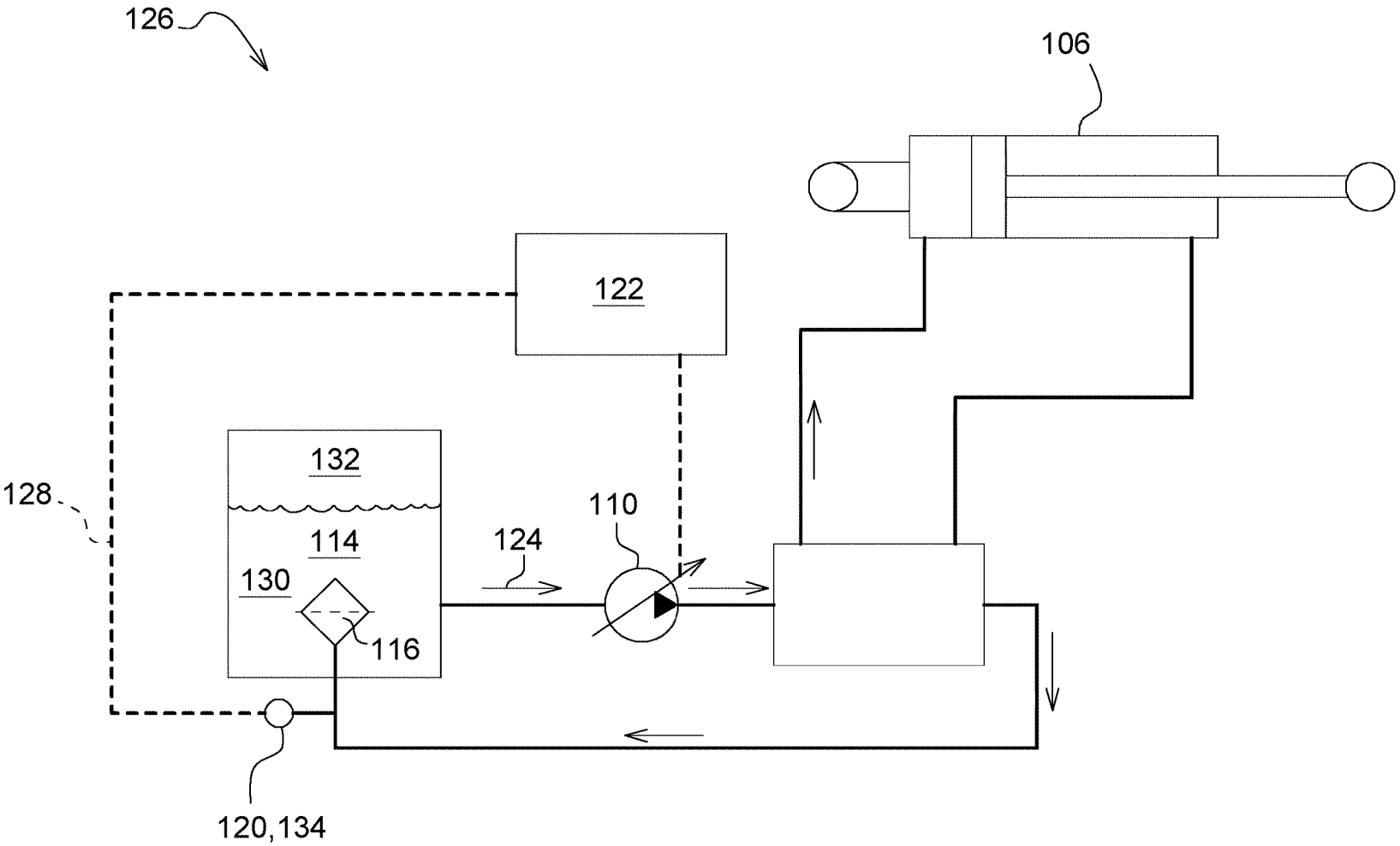
FIG. 2 is a schematic of the hydraulic system.

According to an aspect of the present disclosure, the vehicle 100 may comprise a hydraulic fluid reservoir 114, a hydraulic fluid pump 110, a hydraulic filter 116, a sensor 120 (as shown in FIG. 2), and a vehicle control unit 122 (as shown in FIG. 2).

Hydraulic fluid pump 110 is located in an internal area of the chassis of the vehicle 100, below cab 120 and forward of engine 112. The hydraulic fluid pump 110 is the heart of the hydraulic system 126 creating the flow of hydraulic fluid 124 which supplies the circuit. The hydraulic fluid pump 110 operates on a principle called displacement, wherein the hydraulic fluid 124 is taken in and displaced to another point. This displacement is the volume of hydraulic fluid 124 moved or displaced during each cycle of the hydraulic fluid pump 110. Hydraulic fluid pump 110 is a variable displacement pressure compensated load-sensing axial-piston hydraulic fluid pump that is mechanically driven by engine 112. Alternative embodiments may utilize one or more of a number of alternative hydraulic fluid pump types, including vane, gear, or radial piston, to name but a few types. However, the pump must be a variable displacement pump.

Engine 112 is positioned rearward of hydraulic fluid pump 110 in an internal area of the chassis of vehicle 100. Engine 112 is a forced induction diesel engine which provides mechanical power that hydraulic fluid pump 110 converts into hydraulic power that is distributed to various components of vehicle 100, including tool cylinder 106. Hydraulic fluid pump is hydraulically coupled to hydraulic fluid reservoir 114 such that it draws hydraulic fluid from hydraulic fluid reservoir 114 and outputs it at pressure to hydraulic circuits of vehicle 100.

The hydraulic fluid reservoir 114 serves multiple purposes on vehicle 100, including the collection, storage, cooling, deaeration of hydraulic fluid, and providing positive pressure to the hydraulic fluid pump 110. Hydraulic fluid reservoir 114 comprises mounts for hydraulic filter 116. Hydraulic filter 116 filters hydraulic fluid as it returns to hydraulic fluid reservoir 114 from certain hydraulic circuits on vehicle 100, including those circuits comprising tool cylinder 106 (also shown in FIG. 2).

The hydraulic fluid reservoir 114 is positioned below operator station 118 on the left side of vehicle 100. Hydraulic fluid pump 110 is positioned such that its inlet port for drawing hydraulic fluid from hydraulic fluid reservoir 114 will often be higher than the level of hydraulic fluid in hydraulic fluid reservoir 114. The interior of hydraulic fluid reservoir 114 includes both air 308 and hydraulic fluid 310. The pressure within hydraulic fluid reservoir 114 may be measured by pressure sensor 120.

The hydraulic fluid 124 is the medium by which power is transmitted from the hydraulic fluid pump 110 to the mechanisms which produce work. Furthermore, hydraulic fluid 124 lubricates moving parts, must be stable for long periods of time, must protect the vehicle from rust and corrosion, must resist foaming and oxidation, and must separate readily from air, water, and other contaminants. The hydraulic fluid 124 must also maintain proper viscosity through a wide temperature range, and finally, be readily available and reasonably economical to use. For proper power transmission, the viscosity of the hydraulic fluid 124 must be maintained. Most hydraulic fluids, such as oils, tend to become thin as its temperature increases, and thickens as its temperature drops. If the viscosity is too low, the possibility of leakage past seals and from joints is increased. If the viscosity is too high, sluggish operation results and extra horsepower from the engine 112 is required to push the hydraulic fluid 124 through the system 126 (as shown in FIG. 2). Contaminants such as metallic particles, dust, and dirt not only affect the viscosity of the hydraulic fluid 124, but may damage closely fitted components, and induce oxidation, thereby accelerating rust and corrosion of components. Small particles may score valves, seize pumps, clog orifices, and cause premature failure of components which can become an environmental concern (e.g. failure of the hydraulic fluid reservoir). Therefore, regular maintenance is required for optimum performance. The following describes an apparatus and method which encourages the operator to perform maintenance to prevent irreparable damage to the hydraulic system 126 of a vehicle 100.

FIG. 2 outlines a schematic of the hydraulic system 126. The hydraulic fluid reservoir 114 may have a bottom portion 130 filled with hydraulic fluid 124 and a top portion 132 filled with air. The hydraulic fluid pump 110 may be hydraulically coupled to the hydraulic fluid reservoir 114 so as to draw hydraulic fluid 124 (as shown by the arrows) from the hydraulic fluid reservoir 114. The hydraulic filter 116 may be hydraulically coupled to the hydraulic fluid reservoir 114 so as to filter debris from the hydraulic fluid 124 returning to the hydraulic fluid reservoir 114. The hydraulic filter 116 may be part of either a full-flow system filter or a bypass filter system. A full-flow system filters the entire supply of hydraulic fluid each time it circulates in the hydraulic system 126. Filters in a full-flow system are usually located in the pump inlet line and in the return line to the hydraulic fluid reservoir 114. Additional filters may be located in front of or behind other hydraulic components if they are needed. In contrast, a bypass filter system has its filter connected to a tee in the pressure line so that only a small portion of each hydraulic fluid cycle is diverted through the filter 116. The remainder of the hydraulic fluid goes unfiltered to the system 126 or to the reservoir 114. In an alternative embodiment, a kidney loop may also be used so that some fluid is filtered on the return flow. The location of the hydraulic filter 116 in a hydraulic system 126 will vary with the design of the machine. Regardless of location, the one purpose is to keep the hydraulic fluid 124 clean.

The sensor 120 may be in communication (as shown by the dotted lines) with the vehicle control unit 122 where the sensor 120 is configured to measure a variable indicative of a failure status of the hydraulic filter 128 and communicate the variable 128 to the vehicle control unit 122. Although the sensor 120 and/or switch 134 is positioned outside of the hydraulic fluid reservoir 114. However, the sensor 120 and/or switch 134 may be positioned in multiple locations as long as the sensor 120 and/or switch communicates a variable indicative of a failure status of the hydraulic filter 128 (e.g. a bypass condition).

The hydraulic fluid pump 110, and sensor 120 are in communication with the vehicle control unit 122. The vehicle control unit 122 is a controller which monitors and controls a number of components on a vehicle 100. The vehicle control unit 122 may monitor the sensor 120 or switch 134 and send commands to the hydraulic fluid pump 110 based on the information acquired by the sensor 120 and switch 134. The vehicle control unit 122 may connect to sensor 120 and hydraulic fluid pump 110 through a wiring harness (not shown) or indirectly through a form of wireless communication (not shown).

The vehicle control unit 122 may be configured to derate the hydraulic fluid pump 110 to a first degree when the variable indicative of the failure status 128 of the hydraulic filter is above a first threshold. The variable indicative of failure status may be at least one of a clog, a bypass, and a restriction, as discussed throughout the specification.

The first threshold may be either a number of occurrences or a frequency of occurrences of activation of the switch 134. The switch 134 is a normally closed to ground switch that opens when the hydraulic filter 116 becomes restricted (i.e. clogged with debris). For example, if the switch 134 is activated ten times over a one hundred hour period of operation, the hydraulic fluid pump 110 may be derated to a first degree (i.e. a moderate degree). The number of occurrences and frequency of occurrences may be measured over an incremental unit. The incremental unit may comprise of a time period, a distance, a number of tree counts, a number of dig cycles, or a number of dump cycles, depending on the type of vehicle. The alternative incremental units may be based on vehicle type (e.g. tree counts may be used for feller bunchers).

The vehicle control unit 122 may further be configured to derate the hydraulic fluid pump 110 to a second degree when the variable indicative of the failure status of the hydraulic filter 116 is above a second threshold. For example, if the switch 134 is activated ten times over a fifty hours period of operation, the hydraulic fluid pump 110 may be derated to a second degree (i.e. a severe degree). In one embodiment, the first threshold may be predetermined based on the vehicle type and system configuration. The second threshold may then be set by adding a hysteresis around the first threshold. The second threshold may then be compared to the first threshold over a period of time in order to attain a floating second threshold, and any other subsequent threshold. Hysteresis is the time-based dependence of a system's output on present and past inputs. The dependence arises because the history affects the value of an internal state. To predict future outputs, either its internal state of its history must be known.

In one example, derating the hydraulic fluid pump 110 to a moderate degree of deration may result in slowing machine operation and restricting productive work, while derating the hydraulic fluid pump 110 to a severe degree may restrict the vehicle 100 to operate only in lower level gears (e.g. limping home mode).

The vehicle control unit 122 may derate the hydraulic fluid pump 110 by limiting at least the displacement, output pressure, torque, or power output.

The switch 134 may be further deactivated, be closed to ground, when the pressure differential across the hydraulic filter 116 is below the third threshold.

In one embodiment, the switch 134 may be activated when the pressure differential across the hydraulic filter 116 exceeds a third threshold to determine whether the filter 116 is restricted. In an alternative embodiment, the sensor 120 may measure the pressure differential across the filter directly, and allow an algorithm within the vehicle control unit 122 to determine if the measured pressure differential is indicative of a failure status of the hydraulic filter 116.

Small pressure differences exists across a new hydraulic filter 116 because the hydraulic fluid 124 is being restricted as it passes through—like pushing a screen door open in high wind. As the filter 116 becomes dirty, the pressure difference increases, finally to a point where no hydraulic fluid 124 will flow when the filter 116 is completely plugged. To prevent pressure from building up so high that it might break the filter 116 or starve one of the hydraulic components, a relief valve (not shown) is usually used to bypass the hydraulic fluid 124 around the filter 116. However, when the relief valve opens, dirty hydraulic fluid pours into the hydraulic system 126. Unless the filter 116 or filters are serviced immediately, the dirt in the hydraulic fluid 124 will step up wear in hydraulic components. Thereby, derating the hydraulic fluid pump 110 at a pressure differential across the hydraulic filter 116 between a pressure indicative of a new filter and a pressure when the relief valve opens would drive the operator to perform maintenance to prevent downtime, because derating the hydraulic fluid pump 110 would encumber the vehicle by noticeably slowing the tool cylinder(s) 106 and any other components powered by the hydraulic system 126.

Another means the switch 134 may be activated is when the pressure within the hydraulic fluid reservoir 114 exceeds a fourth threshold. The switch 134 may be further deactivated when the pressure within the hydraulic fluid reservoir 114 drops below the fourth threshold. Furthermore, activation and deactivation of the switch may occur only after an over-pressure or under-pressure condition has existed, or ceased existing, for a period of time, such as five seconds. Adding time delays to the transitions into and out of activation and deactivation of the switch may reduce instabilities, or reduce initiating a derate of the hydraulic fluid pump on transient pressure measurements. This feature applies to both the activation and deactivation of the switch based on the pressure differential across the filter and the pressure within the hydraulic fluid reservoir.

Figure 3:
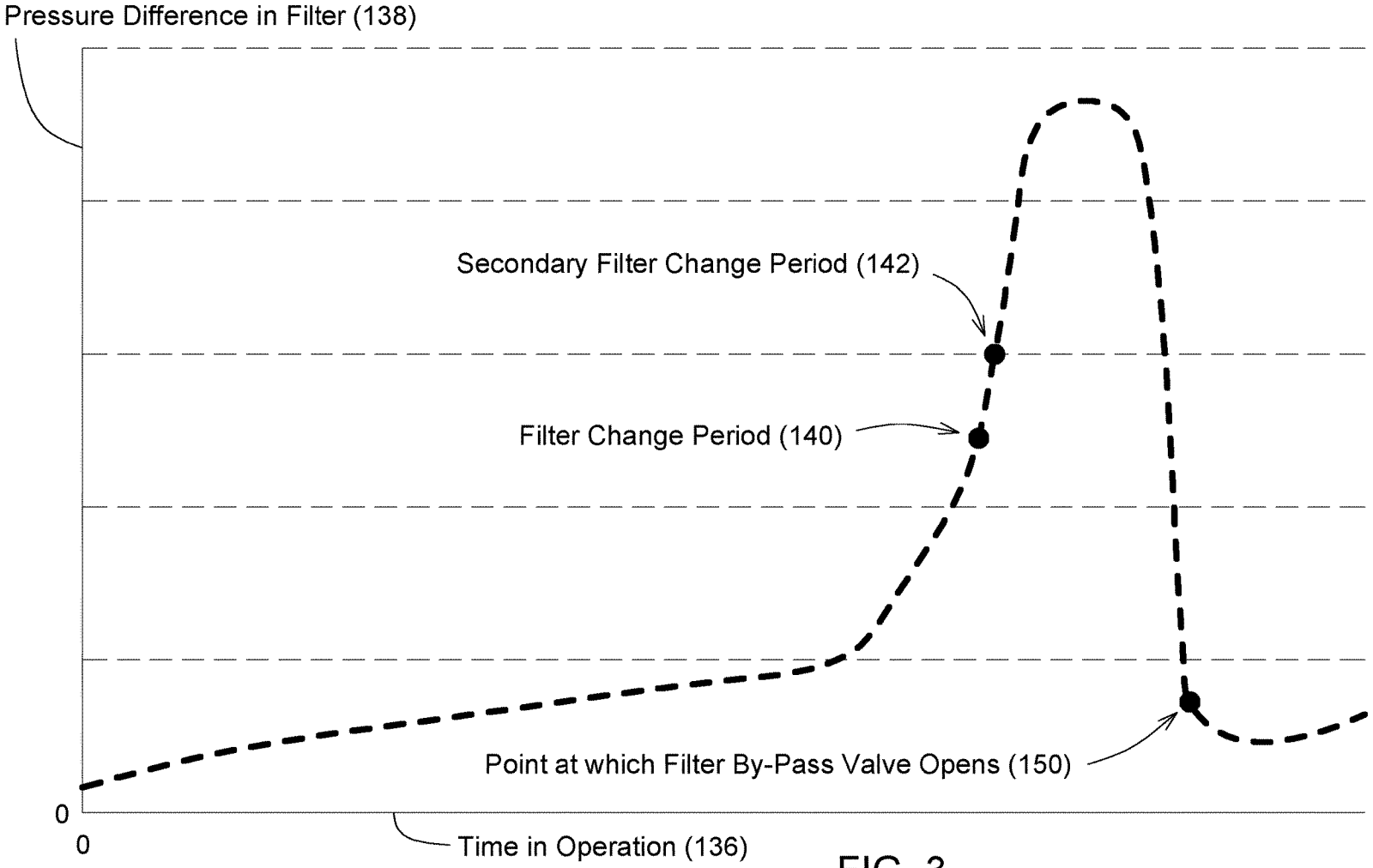
FIG. 3 is a graph showing one means of a range of when a hydraulic filter should be changed (i.e. over a certain # of hours of operation).

FIG. 3 shows a graph displaying the life of a hydraulic filter. The x-axis 136 is the time in operation and the y-axis 138 is the pressure differential across the filter. The first point 140 is the filter change period and the second point 150 is the point at which the bypass valve opens. A third point shows a second filter change period 142 if the operator fails to replace the filter during the first change period 140.

Furthermore, the vehicle control unit 122 may be configured to derate the hydraulic fluid pump 110 directly. Derating the hydraulic fluid pump 110 decreases fluid flow 124 without changing engine speed. The operator maintains control of the engine speed while the vehicle system controls the hydraulic fluid pump 110.

Figure 4:
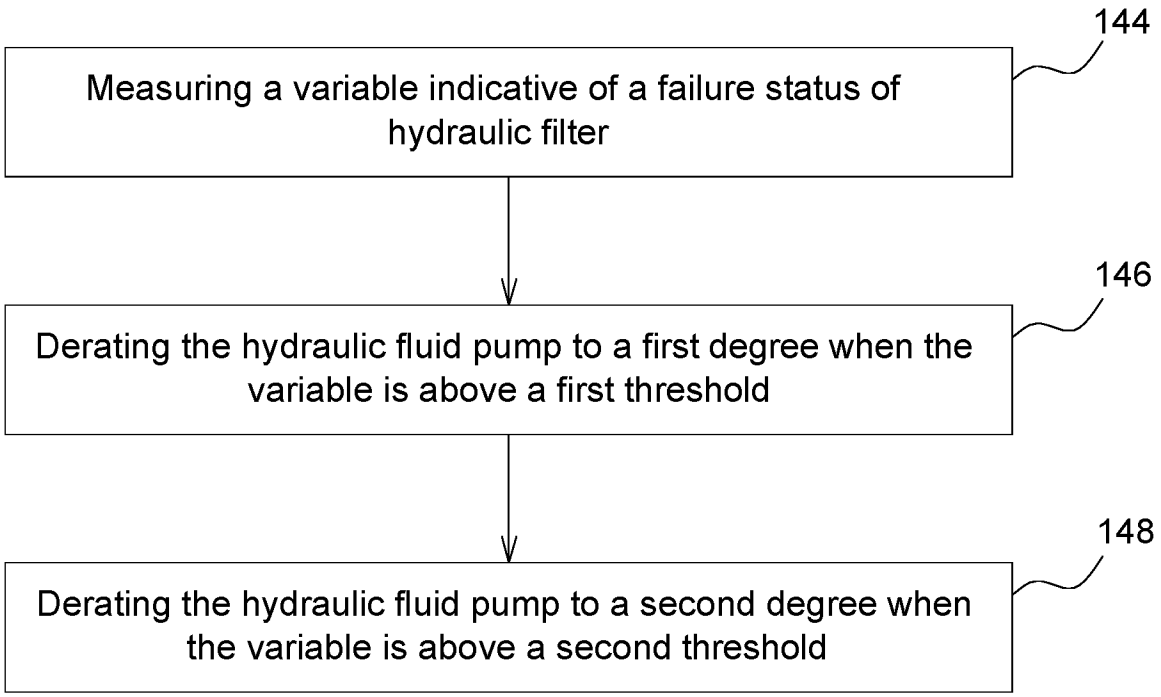
FIG. 4 is a flowchart of the method of controlling a vehicle with a hydraulic fluid reservoir and a hydraulic fluid pump.

Although FIG. 4, is illustrated as a flowchart, the disclosure is not limited to such steps and the order of the steps presented, and it would be well within the skill of one of ordinary skill in the art to reorder, combine, or split many of steps to achieve the same result. According to another aspect of the present disclosure, FIG. 4 discloses a method of controlling a vehicle with a hydraulic fluid reservoir and a hydraulic fluid pump, wherein the hydraulic fluid reservoir comprises a bottom portion filled with a hydraulic liquid and a top portion filled with air. The method may comprise of measuring a variable indicative of a failure status of a hydraulic filter as shown in a first block 144; derating the hydraulic fluid pump to a first degree when the variable is above a first threshold as shown in a second block 146; and derating the hydraulic fluid pump to a second degree when the variable is above a second threshold as shown in a third block 148, wherein the hydraulic fluid pump is hydraulically coupled to the hydraulic fluid reservoir so as to draw hydraulic fluid from the hydraulic fluid reservoir.

Alternative embodiments may send alerts regarding the status of filter failure and any derates which are, or have been commanded. If the filter is over-pressurized or within range, the vehicle control unit 122 may send a signal to a monitor or indicator lamps in operator station 118 alerting the operator to such a state. A signal may also be sent remotely, such as by radio communication, so that a site manager, service algorithm, or maintenance personnel may be alerted of such pressure states. Vehicle control unit 122 may also send signals to alert the operator or remote observer regarding which derates have been used or are currently being commanded, which may aid in understanding any performance changes in vehicle 100.

The terminology used herein is for the purpose of describing particular embodiments or implementations and is not intended to be limiting of the disclosure. As used herein, the singular forms "a", "an" and "the" are intended to include the plural forms as well, unless the context clearly indicates otherwise. It will be further understood that the any use of the terms "has," "have," "having," "include," "includes," "including," "comprise," "comprises," "comprising," or the like, in this specification, identifies the presence of stated features, integers, steps, operations, elements, and/or components, but does not preclude the presence or addition of one or more other features, integers, steps, operations, elements, components, and/or groups thereof.

While the above describes example embodiments of the present disclosure, these descriptions should not be viewed in a restrictive or limiting sense. Rather, there are several variations and modifications which may be made without departing from the scope of the appended claims.

What is claimed is:

1. A vehicle comprising:

a hydraulic fluid reservoir, a bottom portion of the hydraulic fluid reservoir filled with a hydraulic fluid and a top portion filled with air;

a hydraulic fluid pump, wherein the hydraulic fluid pump is hydraulically coupled to the hydraulic fluid reservoir so as to draw hydraulic fluid from the hydraulic fluid reservoir;

a hydraulic filter, wherein the hydraulic filter is hydraulically coupled to the hydraulic fluid reservoir so as to filter debris from the hydraulic fluid returning to the hydraulic fluid reservoir;

a sensor in communication with a vehicle control unit, the sensor configured to measure a variable indicative of failure status of hydraulic filter and communicate the variable to the vehicle control unit; and the vehicle control unit configured to derate the hydraulic fluid pump to a first degree when the variable indicative of failure status of the hydraulic filter is above a first threshold.

2. The vehicle of claim 1, wherein the vehicle control unit is further configured to derate the hydraulic fluid pump to a second degree when the variable indicative of failure status of the hydraulic filter is above a second threshold.

3. The vehicle of claim 1, wherein the variable indicative of the failure status of the hydraulic filter is activation of a switch.

4. The vehicle of claim 3, wherein the switch is activated when the pressure differential across the hydraulic filter exceeds a third threshold.

5. The vehicle of claim 4, wherein the switch is further deactivated when the pressure differential across the hydraulic filter is below the third threshold.

6. The vehicle of claim 3, wherein the switch is activated when the pressure within the hydraulic fluid reservoir exceeds a fourth threshold.

7. The vehicle of claim 6, wherein the switch is further deactivated when the pressure within the hydraulic fluid reservoir drops below the fourth threshold.

8. The vehicle of claim 1, wherein the first threshold is at least one of a number of occurrences and a frequency of occurrences of activation of a switch.

9. The vehicle of claim 8, wherein the at least one of the number and the frequency of the occurrences of activation of the switch is measured over an incremental unit.

10. The vehicle of claim 9, wherein the incremental unit comprises at least one of a time period, a distance, a number of tree counts, a number of dig cycles, and a number of dump cycles.

11. The vehicle of claim 1, wherein the vehicle control unit is configured to derate the hydraulic fluid pump by limiting at least one of its displacement, output pressure, torque, and power output.

12. The vehicle of claim 1 wherein the vehicle control unit is configured to derate the hydraulic fluid pump directly.

13. A method of controlling a vehicle with a hydraulic fluid reservoir and a hydraulic fluid pump, wherein the hydraulic fluid reservoir comprises a bottom portion filled with a hydraulic fluid and a top portion filled with air, the method comprising:

measuring a variable indicative of a failure status of a hydraulic filter;

derating the hydraulic fluid pump to a first degree when the variable is above a first threshold; and derating the hydraulic fluid pump to a second degree when the variable is above a second threshold;

wherein the hydraulic fluid pump is hydraulically coupled to the hydraulic fluid reservoir so as to draw hydraulic fluid from the hydraulic fluid reservoir.

14. The method of claim 13, wherein measuring a variable indicative of failure status of the hydraulic filter comprises measuring at least one of a number of occurrences and frequency of occurrences of activating a switch.

15. The method of claim 14, wherein activating a switch occurs when the pressure differential across the hydraulic filter exceeds a third threshold.

16. The method of claim 14, wherein activating a switch occurs when the pressure within the hydraulic fluid reservoir exceeds a fourth threshold.

17. The method of claim 14, wherein measuring a variable indicative of failure status further comprises measuring over an incremental unit.

18. The method of claim 17, wherein the incremental unit comprises at least one of a time period, distance, number of tree counts, number of dig cycles, and number of dump cycles.

19. The method of claim 13, wherein derating the hydraulic fluid pump comprises limiting at least one of its displacement, output pressure, torque, and power output.

20. The method of claim 13, wherein derating the hydraulic fluid pump comprises a vehicle control unit sending a signal to derate the hydraulic fluid pump directly.

* * * * *